US010490955B2

(12) United States Patent
Emmons et al.

(10) Patent No.: US 10,490,955 B2
(45) Date of Patent: Nov. 26, 2019

(54) POKE-IN ELECTRICAL CONNECTOR

(71) Applicant: Ademco Inc., Golden Valley, MN (US)

(72) Inventors: David J. Emmons, Plymouth, MN (US); Travis Read, Little Canada, MN (US); Steven L. Wolff, Hamel, MN (US); Eric Barton, Eden Prairie, MN (US); Ladislav Janovec, Chomutov (CZ)

(73) Assignee: Ademco Inc., Golden Valley, MN (US)

( * ) Notice: Subject to any disclaimer, the term of this patent is extended or adjusted under 35 U.S.C. 154(b) by 0 days.

(21) Appl. No.: 15/629,490

(22) Filed: Jun. 21, 2017

(65) Prior Publication Data

US 2017/0288347 A1 Oct. 5, 2017

Related U.S. Application Data

(63) Continuation of application No. 14/513,577, filed on Oct. 14, 2014, now Pat. No. 9,748,708.

(51) Int. Cl.
*H01R 13/707* (2006.01)
*H01R 13/629* (2006.01)
(Continued)

(52) U.S. Cl.
CPC ..... *H01R 13/707* (2013.01); *H01H 13/14* (2013.01); *H01R 4/4836* (2013.01);
(Continued)

(58) Field of Classification Search
CPC ..... H01R 4/4836; H01R 12/7076; H01R 13/62933; F24F 11/30; F24F 11/88; F24F 11/89
See application file for complete search history.

(56) References Cited

U.S. PATENT DOCUMENTS 3,051,001 A 8/1962 Laviana et al.
3,096,935 A 7/1963 Gibson
(Continued)

FOREIGN PATENT DOCUMENTS

CA 658329 A 2/1963
CA 772736 A 11/1967
(Continued)

OTHER PUBLICATIONS

Enviromental Technologies, Inc., "Enviro-Tec ETST4H 2" Square Thermostat Mounting Instructions," 1 pages, downloaded Feb. 21, 2016.

(Continued)

*Primary Examiner* — Felix O Figueroa
(74) *Attorney, Agent, or Firm* — Shumaker & Sieffert, P.A.

(57) ABSTRACT

An electrical connector includes a housing having contact channels with electrical contacts received therein each having a poke-in spring beam configured to engage an electrical wire when poked-in to the housing. The electrical contact is movable between a resting position when no wire is present in the wire channel and a clearance position where the electrical contact allows the electrical wire to be removed from the wire channel. Pivot levers are held by the housing and are coupled to corresponding electrical contacts with a pivot end pivotably coupled to the housing and a push button end having a push button pressed to move the corresponding electrical contact to the clearance position. When the electrical wire is loaded into the wire channel, the electrical contact is positioned in a pinching position in which the spring beam pinches against the electrical wire in physical contact with the electrical wire.

13 Claims, 5 Drawing Sheets

(51) Int. Cl.
*H01H 13/14* (2006.01)
*H01R 12/70* (2011.01)
*H01R 4/48* (2006.01)

(52) U.S. Cl.
CPC ... *H01R 12/7076* (2013.01); *H01R 13/62933* (2013.01); *H01H 2201/00* (2013.01)

(56) References Cited

U.S. PATENT DOCUMENTS 3,152,851 A 10/1964 McLaughlin
3,310,646 A 3/1967 Edwards
3,999,732 A 12/1976 Stephens
4,054,345 A 10/1977 Sherwood
4,119,936 A 10/1978 Laviana et al.
4,150,718 A 4/1979 Kolbow et al.
4,295,180 A 10/1981 Herron et al.
4,421,271 A 12/1983 Shavit
4,431,134 A 2/1984 Hendricks et al.
4,587,403 A 5/1986 Shapess
4,669,654 A 6/1987 Levine et al.
4,998,085 A 3/1991 Johnson
5,024,265 A 6/1991 Buchholz et al.
5,107,918 A 4/1992 McFarlane et al.
5,317,670 A 5/1994 Elia
5,485,954 A 1/1996 Guy et al.
5,729,442 A * 3/1998 Frantz ..... H01R 9/24 361/728
D402,569 S 12/1998 Papic et al.
6,102,749 A * 8/2000 Lynn ..... G05D 23/1902 439/810
6,169,337 B1 1/2001 Yoshida et al.
6,347,747 B1 2/2002 Nesbitt
6,362,953 B1 * 3/2002 Ohlwine ..... H05K 5/0017 312/223.2
6,666,713 B1 12/2003 Norvelle
6,888,441 B2 5/2005 Carey
7,140,551 B2 11/2006 De Pauw et al.
7,159,789 B2 * 1/2007 Schwendinger ... G05D 23/1904 236/1 C
7,161,483 B2 1/2007 Chung
7,222,800 B2 5/2007 Wruck
7,227,080 B2 6/2007 Kregle et al.
7,271,338 B1 9/2007 Rohmer
7,344,422 B2 3/2008 Helmreich
7,360,376 B2 4/2008 Juntunen et al.
D568,719 S 5/2008 Gorin et al.
7,569,777 B1 8/2009 Gillam
7,617,988 B2 11/2009 Morrow et al.
7,633,743 B2 * 12/2009 Barton ..... H05K 5/0013 361/679.01
7,713,083 B1 5/2010 Sun et al.
7,726,581 B2 6/2010 Naujok et al.
7,832,652 B2 11/2010 Barton et al.
7,904,608 B2 3/2011 Price
7,916,489 B2 3/2011 Okuya
7,938,336 B2 5/2011 Rhodes et al.
8,014,159 B2 9/2011 Doblar et al.
8,144,482 B2 3/2012 Sato et al.
8,089,032 B2 6/2012 Beland et al.
8,237,064 B2 8/2012 Trolese et al.
8,262,422 B1 9/2012 Chiang
8,364,319 B2 1/2013 Roosli
8,494,681 B2 7/2013 Sartain et al.
8,511,576 B2 8/2013 Warren et al.
8,511,577 B2 8/2013 Warren et al.
8,708,242 B2 4/2014 Connor et al.
8,727,611 B2 5/2014 Huppi et al.
8,752,771 B2 6/2014 Warren et al.
8,802,981 B2 8/2014 Wallaert et al.
9,026,232 B2 5/2015 Fadell et al.
9,046,414 B2 6/2015 Fadell et al.
9,092,039 B2 7/2015 Fadell et al.
9,121,623 B2 * 9/2015 Filson ..... G05D 23/1902
9,247,378 B2 1/2016 Bisson et al.
9,282,654 B2 3/2016 Bick et al.
9,419,361 B2 * 8/2016 Daily ..... H01R 13/193
9,423,805 B2 8/2016 Novotny et al.
9,494,332 B2 11/2016 Filson et al.
9,667,009 B1 5/2017 Read et al.
9,686,880 B1 6/2017 Khoury et al.
D794,478 S 8/2017 Read et al.
9,735,482 B1 8/2017 Read et al.
9,735,518 B1 8/2017 Read et al.
9,746,859 B2 * 8/2017 Conner ..... G05D 23/1919
9,748,708 B2 8/2017 Mostoller et al.
9,768,564 B2 9/2017 Read et al.
9,774,158 B2 9/2017 Barton et al.
9,780,511 B2 10/2017 Janovec et al.
2005/0103875 A1 5/2005 Ashworth et al.
2005/0114234 A1 5/2005 Thomas et al.
2005/0194457 A1 9/2005 Dolan
2006/0192022 A1 8/2006 Barton et al.
2008/0194138 A1 8/2008 Wu et al.
2008/0274630 A1 11/2008 Shelton et al.
2009/0261767 A1 10/2009 Butler et al.
2010/0084482 A1 4/2010 Kennedy et al.
2010/0293991 A1 11/2010 Brown et al.
2011/0318972 A1 12/2011 Koellmann
2014/0062659 A1 3/2014 Roosli et al.
2014/0190679 A1 7/2014 Roosli et al.
2014/0222367 A1 8/2014 Huppi et al.
2014/0226286 A1 8/2014 Novotny et al.
2014/0268452 A1 9/2014 Khoury et al.
2014/0268470 A1 9/2014 Sapak et al.
2014/0319236 A1 10/2014 Novotny et al.
2014/0321092 A1 10/2014 Novotny et al.
2015/0037992 A1 2/2015 Perez, Jr.
2015/0096352 A1 4/2015 Peterson et al.
2015/0104970 A1 4/2015 Smith et al.
2015/0144705 A1 5/2015 Thiruvengada et al.
2015/0159903 A1 6/2015 Marak et al.
2015/0327375 A1 11/2015 Bick et al.
2016/0020590 A1 1/2016 Roosli et al.
2016/0087363 A1 3/2016 Daily et al.
2016/0104981 A1 4/2016 Mostoller et al.
2017/0134214 A1 5/2017 Sethuraman et al.
2017/0234560 A1 8/2017 Novotny et al.
2017/0234565 A1 8/2017 Emmons et al.
2017/0234568 A1 8/2017 Read et al.
2017/0234569 A1 8/2017 Emmons et al.
2017/0236766 A1 8/2017 Read et al.
2017/0237246 A1 8/2017 Janovec et al.

FOREIGN PATENT DOCUMENTS

CA 1249869 A 2/1989
CA 2062076 C 5/2000
CN 1118426 A 3/1996
CN 101180608 A 5/2008
CN 102394387 A 3/2012
CN 203536578 U 4/2014
DE 102012005465 B3 5/2013
DE 202013101582 U1 8/2014
EP 0976957 A2 2/2000
EP 1622224 A1 2/2006
FR 2935201 A1 2/2010
WO 2016106227 A1 6/2016

OTHER PUBLICATIONS

Honeywell, "FocusPro 6000 Series Programmable Digital Thermostat, Installation Instructions," 24 pages, Mar. 2014.
Honeywell, "Heating/Cooling Thermostat and Subbase or Heating or Cooling Thermostat and Wallplate, T8195A,B/Q682 Owner's Manual," 24 pages, Dec. 1994.
Honeywell, "Lyric Installation Guide," 9 pages, downloaded Feb. 20, 2016.
Honeywell, "TB6575/TB8575 SuitePRO Digital Fan Coil Thermostats, Installation Instructions," 20 pages, Oct. 2013.
https://nest.com/support/pro/article/Help-with-Installation-and-set-up, "Nest Learning Thermostat Advanced Installation and Setup Help for Professional Installers," 22 pages, printed Feb. 20, 2016.

(56) References Cited

OTHER PUBLICATIONS https://www.google.com/search?q=nest+sub+base&espv=2&biw=1032&bih=946&source=lnms&tbm=isch&sa=X&ved=0ahUKEwiNmea73YbLAhWJdR4KH . . . , "Thermostat Subbase—Google Search," 28 pages, printed Feb. 20, 2016.
https://www.google.com/search?q=nest+sub+base&espv=2&biw=1032&bih=946&source=lnms&tbm=isch&sa=X&ved=0ahUKEwiNmea73YbLAhWJdR4KH . . . , "Thermostat Wall Plate—Google Search," 16 pages, printed Feb. 20, 2016.
ICM Controls, "SC700V Non-Programmable Fan Coil Thermostat," 2 pages, downloaded Feb. 21, 2016.
Infineon, "TPM Key Backup and Recovery for Trusted Platforms," pp. 1-17, Sep. 21, 2006.
Lux, "WP567 LUX Universal Wallplate—Fits Thermostats TX500U, TX9100U, TX9600TS," available on Amazon.com, downloaded May 20, 2015.
Pro, "Heavy Duty Products for HVAC Professionals," 2 pages, downloaded Feb. 8, 2016.
Ritetemp, "Install Guide 6004," 7 pages, downloaded Feb. 21, 2016.
White-Rodgers, "F61-2XXX Adaptor Plate Assembly, Installation Instructions," 2 pages, downloaded Feb. 21, 2016.
First Office Action and Search Report, and translation thereof, from counterpart Chinese Application No. 201580068246.5, dated Oct. 9, 2018, 20 pp.
International Search Report and Written Opinion of International Application No. PCT/US2015/054208, dated Dec. 12, 2015, 11 pp.
International Preliminary Report on Patentability from International Application No. PCT/US2015/054208, dated Apr. 18, 2017, 8 pp.
Response to Communication pursuant to Rules 161(1) and 162 EPC dated May 29, 2017, from counterpart European Application No. 15782197.6, filed Oct. 4, 2017, 3 pp.
Response to Rule 137(4) and Examination Report dated Aug. 15, 2018, from counterpart European Application No. 15782197.6, filed Sep. 14, 2018, 3 pp.
Prosecution History from U.S. Appl. No. 14/513,577, dated Nov. 4, 2015 through Mar. 30, 2017, 90 pp.
Invitation pursuant to Rule 137(4) and Examination Report from counterpart European Application No. 15782197.6, dated Aug. 15, 2018, 2 pp.
Response to Examination Report dated Jan. 10, 2019, from counterpart European Application No. 15782197.6, filed Apr. 29, 2019, 11 pp.
Second Office Action and Search Report, and translation thereof, from counterpart Chinese Application No. 201580068246.5, dated Jun. 4, 2019, 10 pp.
Communication pursuant to Article 94(3) EPC dated Jan. 10, 2019, from counterpart European Application No. 15782197.6, 4 pp.

* cited by examiner

POKE-IN ELECTRICAL CONNECTOR

This is a continuation of co-pending U.S. patent application Ser. No. 14/513,577, filed Oct. 14, 2014, which is incorporated herein by reference.

BACKGROUND OF THE INVENTION

The subject matter described herein relates generally to a poke-in electrical connector for terminating electrical wires.

Some electrical connectors that terminate electrical wires include terminal blocks that pivot between open and closed positions. In the open position, the terminal blocks are oriented to receive the ends of corresponding electrical wires, which may be stripped to expose the conductors thereof. The terminal blocks are pivoted from the open positions to the closed positions to engage the electrical conductors of the electrical wires in electrical connection with corresponding electrical contacts of the electrical connector.

Pivot block style connectors are not without their disadvantages. For example, the electrical contacts of at least some known pivot block style connectors require the use of a separate compliant spring to hold the electrical contact in physical contact with the wire. Such connectors require multiple parts and may have high spring force. Such connectors tend to buckle smaller wires when the wires are poked-in to the connector.

SUMMARY OF THE INVENTION

In an embodiment, an electrical connector is provided that includes a housing having contact channels and wire channels open to corresponding contact channels. The wire channels are configured to receive an electrical wire during a poke-in termination. Electrical contacts are received in corresponding contact channels and held by the housing. Each electrical contact includes a poke-in spring beam configured to engage the electrical wire when poked-in to the corresponding wire channel. The spring beam has a separable wire interface configured to engage in physical contact with the electrical wire. The electrical contact is movable between a resting position when no wire is present in the wire channel and a clearance position where the electrical contact allows the electrical wire to be removed from the wire channel. Pivot levers are held by the housing and are coupled to corresponding electrical contacts. The pivot levers move with the corresponding electrical contacts. Each pivot lever extends between a pivot end and a push button end. The pivot end is pivotably coupled to the housing and the push button end has a push button configured to be pressed in a pressing direction by an operator to move the corresponding electrical contact to the clearance position. When the electrical wire is loaded into the wire channel, the electrical contact is positioned in a pinching position between the clearance position and the resting position in which the spring beam pinches against the electrical wire in physical contact with the electrical wire.

In another embodiment, a thermostat assembly is provided that includes a thermostat having a printed circuit having mating contacts and an electrical connector configured to be mated with the thermostat. The electrical connector includes a housing having contact channels and wire channels open to corresponding contact channels. The wire channels are configured to receive an electrical wire during a poke-in termination. Electrical contacts are received in corresponding contact channels and held by the housing.

Each electrical contact includes a poke-in spring beam configured to engage the electrical wire when poked-in to the corresponding wire channel. The spring beam has a separable wire interface configured to engage in physical contact with the electrical wire. The electrical contact is movable between a resting position when no wire is present in the wire channel and a clearance position where the electrical contact allows the electrical wire to be removed from the wire channel. The electrical contact includes pin beams directly electrically connected to the corresponding mating contact. Pivot levers are held by the housing and are coupled to corresponding electrical contacts. The pivot levers move with the corresponding electrical contacts. Each pivot lever extends between a pivot end and a push button end. The pivot end is pivotably coupled to the housing and the push button end has a push button configured to be pressed in a pressing direction by an operator to move the corresponding electrical contact to the clearance position. When the electrical wire is loaded into the wire channel, the electrical contact is positioned in a pinching position between the clearance position and the resting position in which the spring beam pinches against the electrical wire in physical contact with the electrical wire.

DETAILED DESCRIPTION OF THE DRAWINGS

Figure 1:
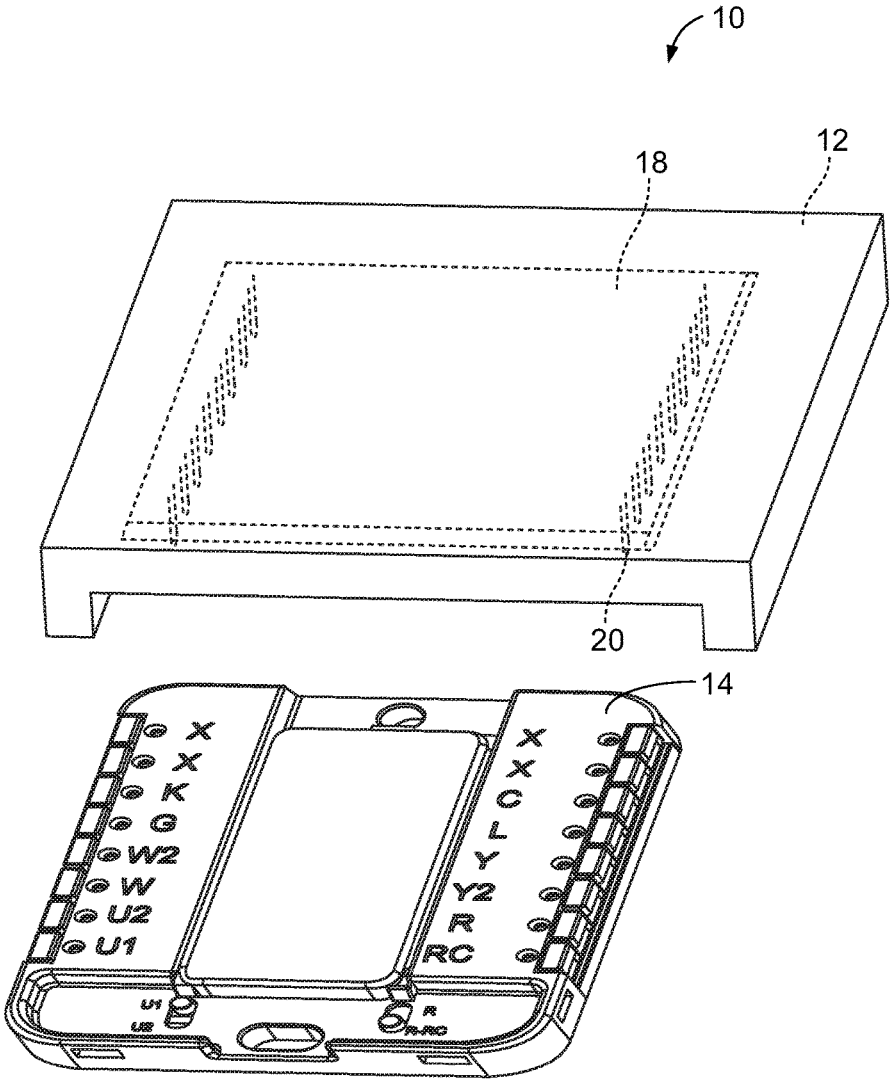
FIG. 1 is an exploded perspective view of an embodiment of a thermostat assembly.

FIG. 1 is an exploded perspective view of an embodiment of a thermostat assembly 10. The thermostat assembly 10 includes a thermostat 12 and an electrical connector 14. The electrical connector 14 is configured to be mounted to a wall and electrical wires 16 (shown in FIG. 2) may extend from the wall for termination to the electrical connector 14. The thermostat 12 is configured to be mounted to the electrical connector 14 such that the electrical connector 14 is electrically connected with the thermostat 12 and the thermostat 12 is mounted to the wall. But, the electrical connector 14 may be mated with the thermostat 12 in any other configuration, arrangement, and/or the like. For example, in some embodiments the thermostat 12 and/or the electrical connector 14 are not mounted to a wall, but rather are mounted to another surface, such as, but not limited to, a floor, a ceiling, a piece of furniture, a fixture, another structure, and/or the like. In alternative embodiments, the electrical connector 14 may be electrically connected to another type of electronic component other than the thermostat 12. For example, the electrical connector 14 may be terminated to a printed circuit board and may electrically connect wires to the printed circuit board. The use of the electrical connector 14 is not limited to use in a thermostat assembly 10.

The thermostat 12 includes a printed circuit 18 having mating contacts 20. As will be described below, electrical contacts 22 (shown in FIG. 3) of the electrical connector 14 are configured to be mated with the mating contacts 20 of the thermostat 12 to establish an electrical connection between the electrical connector 14 and the thermostat 12. For example, the mating contacts 20 may be plugged into the electrical connector 14 for mating with the electrical contacts 22 held in the electrical connector 14. The electrical connector 14 electrically connects the electrical wires 16 with the printed circuit 18 of the thermostat 12 via the electrical contacts 22 and the mating contacts 20.

Although the electrical connector 14 is shown as defining a portion of the thermostat assembly 10, the electrical connector 14 is not limited to being used as a portion of a thermostat assembly. Rather, the electrical connector 14 additionally or alternatively may mate with any other device besides a thermostat and may be used to terminate electrical wires for any other electrical device besides a thermostat assembly. The thermostat assembly 10 and the thermostat 12 (not shown in FIG. 2) are meant as only one exemplary application of the electrical connector 14.

Figure 2:
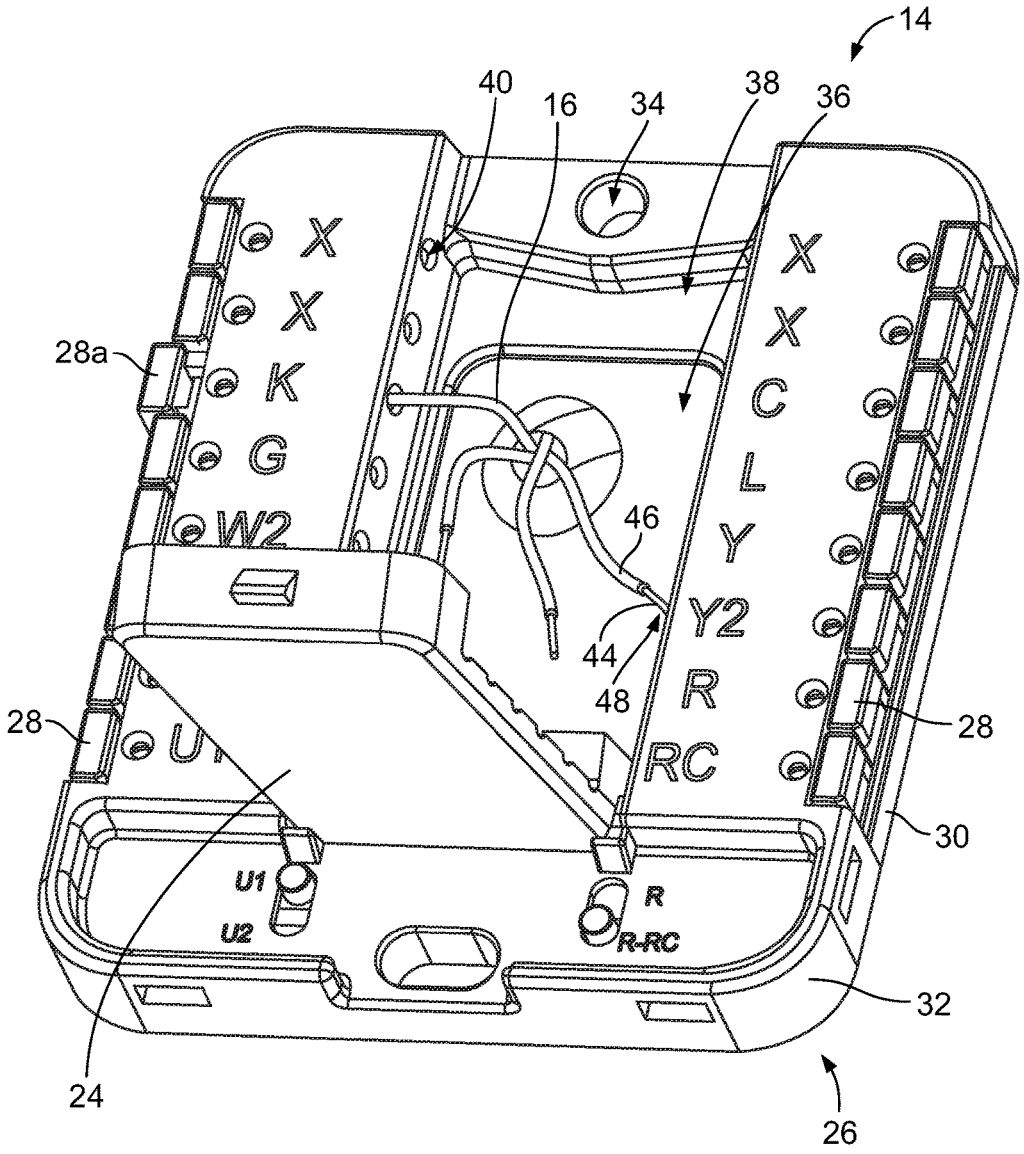
FIG. 2 is a perspective view of an embodiment of an electrical connector of the thermostat assembly.

FIG. 2 is a perspective view of an embodiment of the electrical connector 14. The electrical connector 14 includes a cover 24 that may be pivoted open to expose the electrical wires 16. The electrical connector 14 is a poke-in style connector that allows the electrical wires 16 to be poked-in to the electrical connector 14 for termination to the electrical contacts 22 (shown in FIG. 3). Optionally, the electrical wires 16 are grouped together in a cable (not shown).

The electrical connector 14 includes a housing 26, which holds the electrical contacts 22, and pivot levers 28 that are movable with the electrical contacts 22, such as to release the electrical wires 16 for removal of the electrical wires 16 from the housing 26. The electrical contacts 22 and the pivot levers 28 are held by the housing 26. In the illustrated embodiment, the housing 26 includes a base plate 30 and a cover plate 32. The base plate 30 and the cover plate 32 also define a wall plate assembly in the illustrated embodiment for mounting the electrical connector 14 to a wall. In alternative embodiments, the housing 26 may be devoid of the base plate 30, but rather may be mounted to another structure, such as a printed circuit board. The plate(s) 30 and/or 32 may include openings 34 and/or other features that facilitate mounting the electrical connector 14 on the wall and/or other surface. The plates 30, 32 include respective openings 36, 38 for receiving the electrical wires 16. The cover plate 32 includes a plurality of wire channels 40 that are configured to receive the electrical wires 16. For example, the electrical wires 16 may be poked-in to any of the wire channels 40 for termination to the corresponding electrical contact 22. The housing 26 additionally or alternatively may have other configurations, arrangements, structures, geometries, and/or the like, which may depend on the particular application of the electrical connector 14.

The pivot levers 28 are held by the cover plate 32 of the housing 26 such that the pivot levers 28 are pivotable between a normal or resting position, in which the pivot levers 28 are in an outward position (as compared to the wall or other mounting structure), and a release position, in which the pivot levers 28 are pressed inward to an inward position (as compared to the outward position). The outward position may be referred to as a closed position and the inward position may be referred to as an open position. The pivot levers 28 are pivotable along an arc A between the outward and inward positions. The pivot levers 28 are shown in the normal or resting positions in FIG. 2, with the exception of a pivot lever 28*a* that is shown in an inward position, which may correspond to a position in which one of the wires 16 is received in the housing 26 and mated with the corresponding electrical contact 22. The inward position may corresponding with the pivot lever 28*a* being pressed inward by an operator to release the wire 16 from the housing 26.

In the illustrated embodiment, the electrical wire 16 includes an electrical conductor 44 and an insulation layer 46 surrounding the electrical conductor 44. The insulation layer 46 has been stripped away at an end 48 of the electrical wire 16 to expose the electrical conductor 44 along the end 48. The electrical wire 16 is received within the selected wire channel 40 such that the exposed segment of the electrical conductor 44 is physically engaged in electrical connection with the corresponding electrical contact 22.

Figure 3:
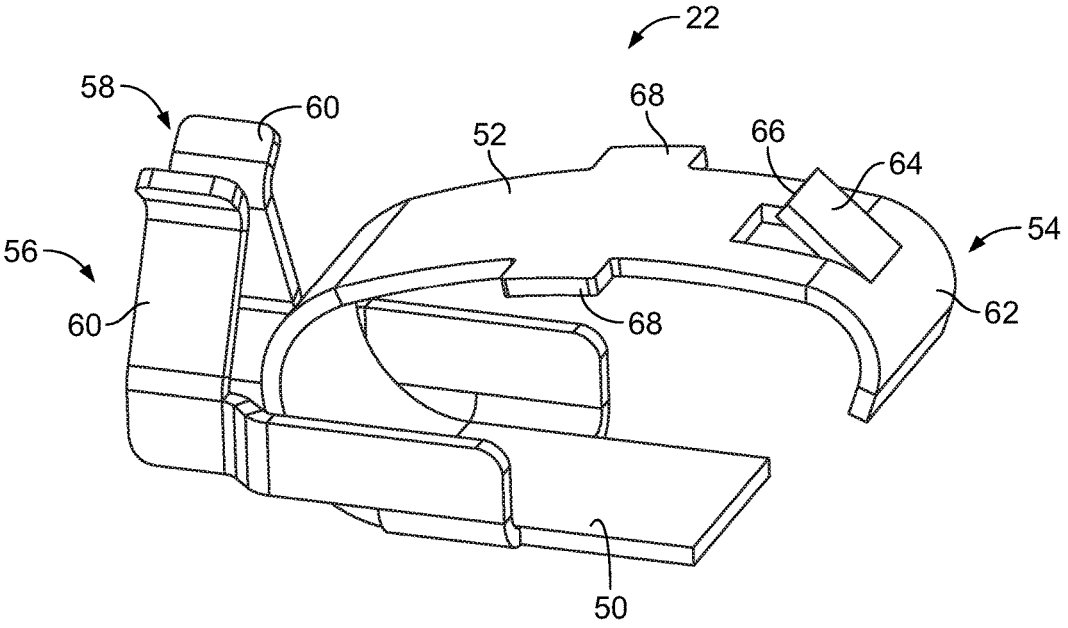
FIG. 3 is a perspective view of an electrical contact for the electrical connector formed in accordance with an exemplary embodiment.

FIG. 3 is a perspective view of one of the electrical contacts 22 in accordance with an exemplary embodiment. The electrical contact 22 includes a base 50 and a spring beam 52 extending therefrom. The spring beam 52 is configured to be electrically connected to the electrical wire 16 (shown in FIG. 2). The electrical contact 22 extends between a wire end 54 and a pin end 56. The electrical contact 22 is configured to engage the electrical wire 16 at the wire end 54 in a poke-in or pinching type of connection.

The pin end 56 includes a contact interface 58 at which the electrical contact 22 is configured to mate with the corresponding mating contact 20 (shown in FIG. 1) of the thermostat 12 (shown in FIG. 1). In the illustrated embodiment, the contact interface 58 includes opposing pin beams 60 that pinch the corresponding mating contact 20 therebetween to engage in physical contact with the mating contact 20 and thereby establish an electrical connection between the contacts 20, 22. The pin beams 60 oppose each other and are spring biased toward each other. When the mating contact 20 is inserted between the pin beams 60, the pin beams 60 spread apart and press against the mating contact 20 to ensure a reliable electrical connection between the electrical contact 22 and the mating contact 20. In the illustrated embodiment, the pin beams 60 extend from opposite sides of the base 50 and extend rearward of the spring beam 52 to the pin end 56.

The pin beams 60 may have other configurations in alternative embodiments. For example, in an alternative embodiment, rather than pin beams accepting the mating contact 20, the pin end 56 may include one or more pin beams, such as compliant pins or solder pins, which may be terminated to another device, such as a printed circuit board. The compliant pins or solder pins may extend downward through the housing 26 to mate with the printed circuit board. In such embodiments, rather than being terminated to a thermostat, the electrical contact 22 may be terminated to any type of printed circuit board.

The spring beam 52 is cantilevered from the base 50 and follows a generally arcuate path to a tip 62 at the wire end 54. The tip 62 is curved for mating with the electrical wire 16 and to prevent stubbing. In an exemplary embodiment, the spring beam 52 extends from a rear of the base 50 and is curved to extend forward of the base 50. As such, the spring beam 52 has a long effective length to provide good spring characteristics. When the spring beam 52 is deformed and flexed inward, such as when the electrical wire 16 is mated with the electrical contact 22, the spring beam 52 may be spring biased against the electrical wire 16. The long effective length reduces the risk of plastic deformation, thus insuring that the electrical contact 22 maintains the spring characteristics. The spring beam 52 may be curved or cupped at the wire end 54 to wrap at least partially around the pivot lever 28 (shown in FIG. 2).

In an exemplary embodiment, the spring beam 52 includes a burr 64 at the wire end 54. The burr 64 extends outward from the spring beam 52 to an edge 66. The burr 64 is configured to engage in physical contact with the electrical conductor 44 of the corresponding electrical wire 16. The burr 64 may or may not puncture the electrical conductor 44 of the corresponding electrical wire 16. The burr 64 may facilitate holding the corresponding electrical wire 16 to the electrical contact 22 (i.e., may facilitate maintaining the mechanical and electrical connection between the electrical conductor 44 of the corresponding electrical wire 16 and the electrical contact 22), for example via stiction between the burr 64 and the electrical conductor 44, via compression of the electrical conductor 44, and/or via puncturing of the electrical conductor 44. For example, the burr 64 may increase the force required to pull the corresponding electrical wire 16 out of the electrical connector 14.

In an exemplary embodiment, the electrical contact 22 includes retention tabs 68 extending outward from opposite sides of the spring beam 52. The retention tabs 68 are used to retain the mechanical connection between the electrical contact 22 and the pivot lever 28.

Figure 4:
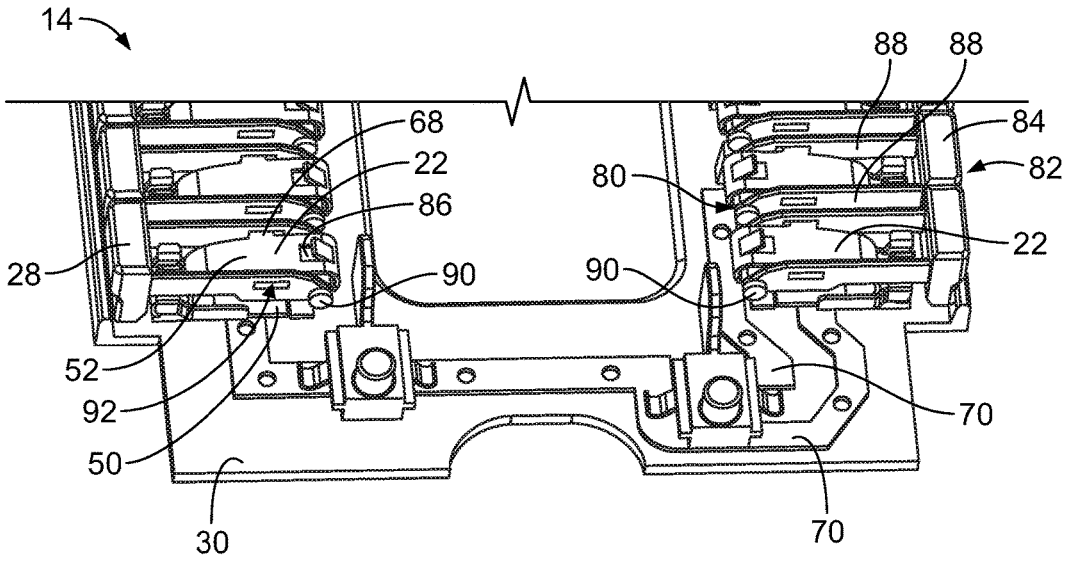
FIG. 4 is a prospective view of a portion of the electrical connector showing the electrical contacts and pivot levers of the electrical connector.

FIG. 4 is a perspective view of a portion of the electrical connector 14 with the cover plate 32 (shown in FIG. 2) removed to illustrate the electrical contacts 22 and pivot levers 28. In an exemplary embodiment, the electrical connector 14 includes one or more circuits 70 arranged in the base plate 30. Optionally, when the electrical contacts 22 are loaded in the base plate 30, the bases 50 of the electrical contacts 22 may be electrically connected to one or more of the circuits 70. In other embodiments, the circuits 70 may be provided in other components, such as a printed circuit board, and the electrical contacts 22 may be electrically connected to the circuits of the printed circuit board. For example, the bases 50 may be soldered to the printed circuit board. Alternatively, pins or beams may extend from the bases 50 that are terminated to the printed circuit board. The base plate 30 may include one or more guide or retention features that locate and/or retain the electrical contacts 22 in or on the base plate 30. The pivot levers 28 are coupled to corresponding electrical contacts 22.

The pivot levers 28 extend between a pivot end 80 and a push button end 82. The pivot end 80 is configured to be pivotably coupled to the housing 26, such as to the cover plate 32. The push button end 82 has a push button 84 configured to be pressed in a pressing direction, such as inward or toward the base plate 30, by an operator. For example, the push button 84 may be pressed to move the pivot lever 28 to a release position. As the pivot lever 28 is moved to the release position, the pivot lever 28 causes the electrical contact 22 to move to a clearance position, in which the electrical wire 16 (shown in FIG. 2) may be removed from the housing 26. The pivot lever 28 includes a beam 86 at the pivot end 80 that extends between a pair of arms 88 that extend rearward from the pivot end 80 to the push button 84 at the push button end 82. The arms 88 extend along the outside of the spring beam 52 of the electrical contact 22. Pivot posts 90 extend outward from the arms 88 at or near the pivot end 80. The pivot lever 28 is configured to pivot about the pivot posts 90. The arms 88 include openings 92 therethrough. The retention tabs 68 of the electrical contact 22 are received in corresponding openings 92. Optionally, the openings 92 may be elongated and have a width that is wider than the retention tabs 68 such that the retention tabs 68 may be able to slide forward and backward within the openings 92 as the spring beam 52 is moved and flexed. As such, the pivot lever 28 does not bind the electrical contact 22, such as when the electrical wire 16 is mated with the electrical contact 22 and/or when the pivot lever 28 releases the electrical contact 22.

Figure 5:
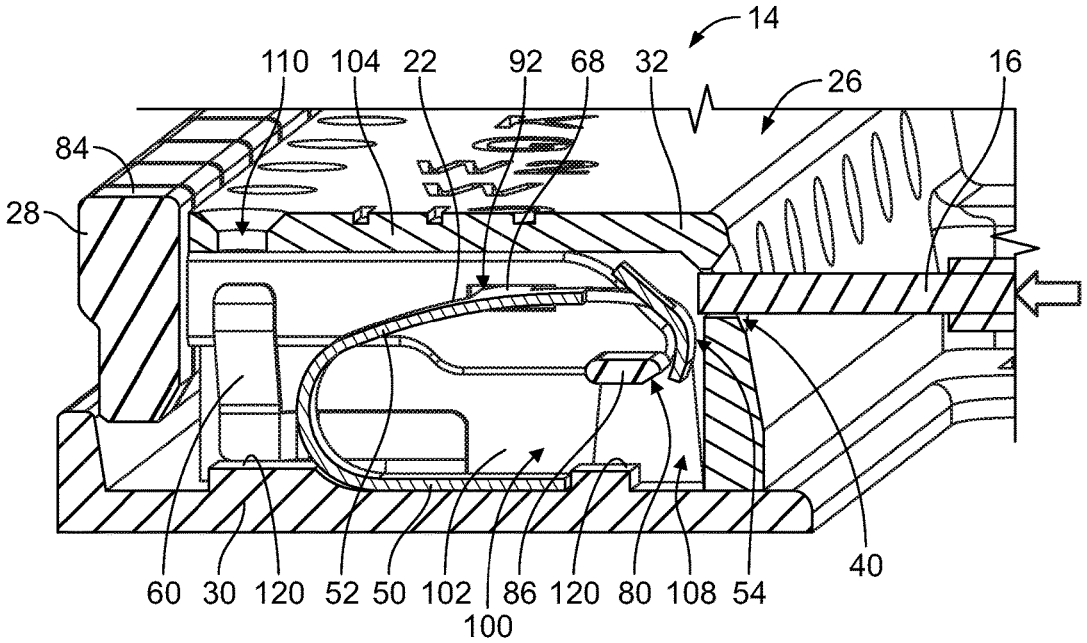
FIG. 5 is a cross sectional view of a portion of the electrical connector.

FIG. 5 is a cross sectional view of the electrical connector 14 showing an electrical wire 16 being poked into one of the wire channels 40 of the cover plate 32. The electrical contact 22 is positioned to receive the electrical wire 16. The pivot lever 28 is shown in the normal or outward position and the electrical contact 22 is shown in the resting position. The wire end 54 of the electrical contact 22 is aligned with the wire channel 40 such that the spring beam 52 interferes with loading of the electrical wire 16 into the wire channel 40. As such, as the electrical wire 16 is poked into the wire channel 40, the electrical wire 16 engages the spring beam 52 and forces the spring beam 52 to deflect inward. As the spring beam 52 deflects inward, the pivot lever 28 is similarly pivoted inward.

The cover plate 32 of the housing 26 includes a plurality of contact channels 100 formed therein. The electrical contacts 22 and pivot levers 28 are received in corresponding contact channels 100. The contact channels 100 are defined by separating walls 102 between adjacent contact channels 100. The contact channels 100 are defined at an outer end by an outer wall 104 of the cover plate 32. The outer wall 104 is opposite the base plate 30. The base plate 30 defines an inner wall of the contact channels 100. The wire channels 40 extend through a front wall of the cover plate 32 that defines a front of the contact channels 100. The wire channels 40 are open to corresponding contact channels 100 to allow the electrical wires 16 to pass into the contact channels 100 for mating with the electrical contacts 22. The pivot levers 28 extend out of the contact channels 100 to an exterior of the cover plate 32. The push buttons 84 are exposed exterior of the cover plates 32 such that an operator may press downward on the push button 84 to move the pivot lever 28 to the release position. In an exemplary embodiment, the separating wall 102 includes a pocket 108. The pivot posts 90 (shown in FIG. 4) are received in the pockets 108. The pivot posts 90 may pivotably engage the housing 26 within the pocket 108.

In an exemplary embodiment, the housing 26 includes a plurality of pin channels 110 that open to the contact channels 100. The pin channels 110 are configured to receive pins of the mating contacts 20 (shown in FIG. 1). In the illustrated embodiment, the pin channels 110 extend through the outer wall 104. The pin channels 110 are positioned near a rear of the cover plate 32. The electrical contacts 22 are positioned in contact channels 100 such that the pin beams 60 are aligned with the pin channels 110. As such, when the pins of the mating contacts 20 are loaded into the pin channels 110, the pins may be inserted between the pin beams 60 to make an electrical connection directly to the electrical contact 22.

The electrical contacts 22 are received in the contact channels 100 such that the base 50 extends along the base plate 30. The base plate 30 includes locating features 120 for positioning the electrical contact 22 in the contact channels 100. Portions of the electrical contact 22 engage the locating features 120 to position the electrical contact 22. The wire end 54 of the electrical contact 22 extends or wraps around the beam 86 at the pivot end 80 of the pivot levers 28. The retention tabs 68 extend into corresponding openings 92 of the pivot levers 28 to mechanically couple the electrical contact 22 to the pivot lever 28. As such, movement of the electrical contact 22, such as when the spring beam 52 is flexed inward during mating with the electrical wire 16, causes corresponding movement of the pivot lever 28, such as to an inward position. Similarly, movement of the pivot lever 28 may be transferred to the electrical contact 22, such as when the pivot lever 28 is pushed to the release position, the pivot lever 28 may cause the spring beam 52 to flex inward to a clearance position to allow the electrical wire 16 to be removed from the housing 26.

Figure 6:
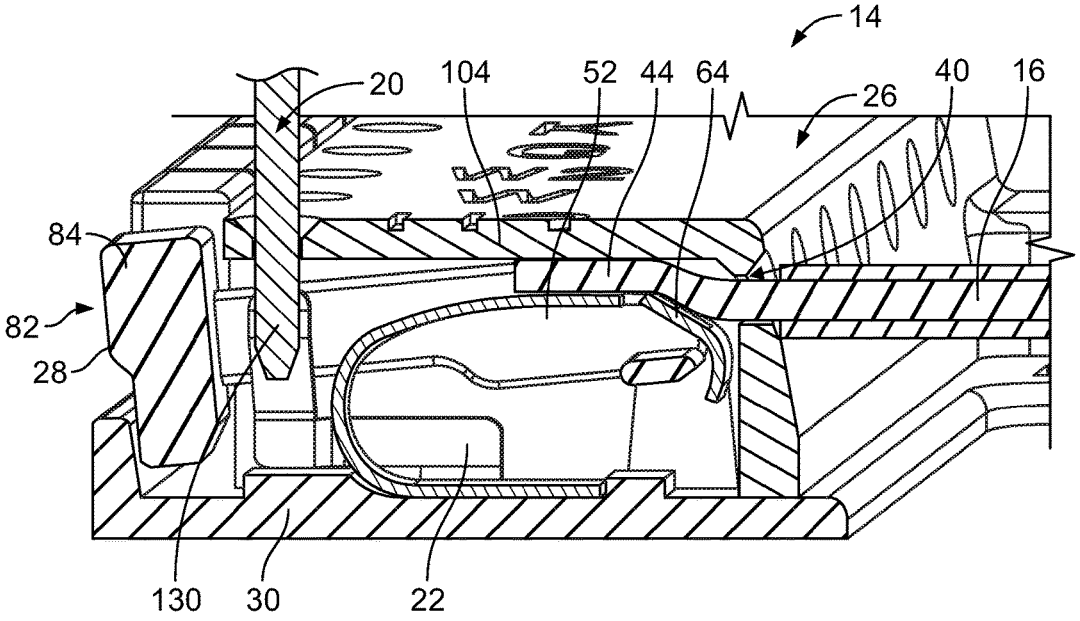
FIG. 6 is a cross sectional view of a portion of the electrical connector.

FIG. 6 is a cross sectional view of the electrical connector 14 showing the electrical contact 22 terminated to the electrical wire 16 and showing a pin 130 of the mating contact 20 electrically connected with the electrical contact 22. The electrical contact 22 defines a direct electrical path between the mating contact 20 and the electrical wire 16. The electrical contact 22 is a single piece, unitary structure that defines a conductive path between the mating contact 20 and the electrical wire 16.

During insertion or poke-in of the electrical wire 16 into the housing 26, the electrical wire 16 forces the electrical contact 22 to flex or move inward toward the base plate 30. The spring beam 52 presses outward against the electrical wire 16 sandwiching or pinching the electrical wire 16 between the spring beam 52 and the outer wall 104. The spring beam 52 is spring biased against the electrical wire 16 to ensure a reliable electrical connection between the electrical contact 22 and the electrical wire 16. The burr 64 may engage or dig into the electrical conductor 44 of the electrical wire 16.

When the electrical contact 22 is flexed inward to a pinching position, the pivot lever 28 is likewise moved inward. For example, the push button end 82 may be pivoted inward toward the base plate 30 to a deflected position. In the deflected position, the push button 84 is located inward relative to push buttons 84 that are in the normal or resting position. As such, a visual indication that the pivot lever 28 has been pivoted or moved inward indicates that the electrical wire 16 is properly positioned in the corresponding wire channel 40 and is in electrical connection with the electrical contact 22.

Figure 7:
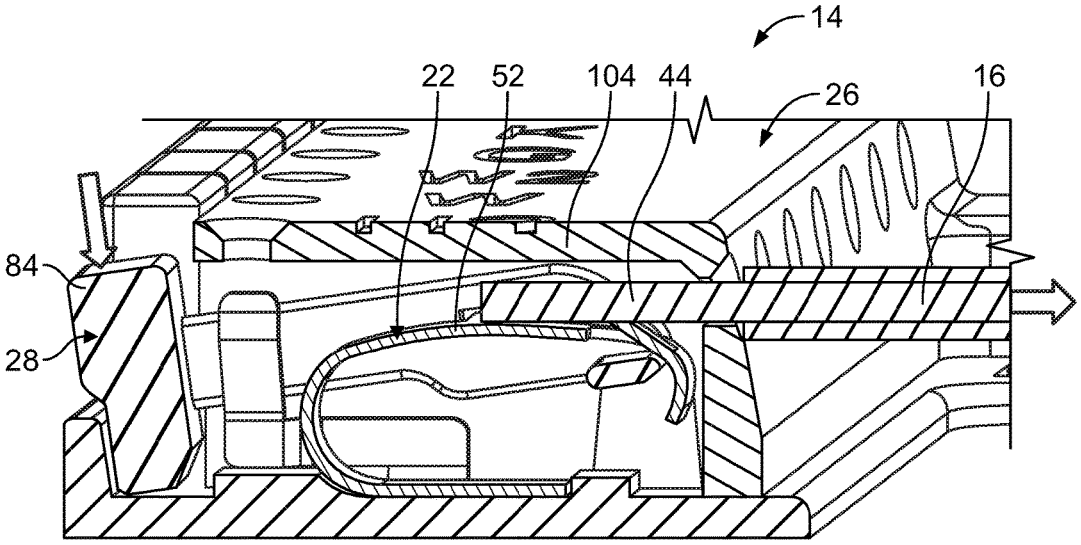
FIG. 7 is a cross sectional view of a portion of the electrical connector.

FIG. 7 is a cross sectional view of the electrical connector 14 showing the pivot lever 28 in the release position. The push button 84 may be pressed in a pressing direction by an operator to move the pivot lever 28 to the release position. As the pivot lever 28 is moved inward, the electrical contact 22, which is coupled to the pivot lever 28, is similarly flexed or moved inward. The electrical contact 22 is moved to a clearance position in which clearance is provided between the spring beam 52 and the outer wall 104 to allow the electrical wire 16 to be pulled out of the housing 26. Once the electrical wire 16 is removed from the housing 26, the push button 84 may be released and the spring beam 52 may return to the normal or resting position, which forces the pivot lever 28 to pivot to the normal or resting position.

The pinch connection between the spring beam 52 and the electrical conductor 44 of the corresponding electrical wire 16 is optionally a separable connection. A "separable connection" is a connection wherein the corresponding electrical wire 16 can be terminated by the electrical contact 22 without damaging the electrical contact 22 and/or without damaging the electrical wire 16. For example, a "separable connection" may be a connection wherein: (1) the corresponding electrical wire 16 can be installed to the electrical contact 22 (i.e., captured between the spring beam 52 with the compliant pinch connection) and later uninstalled from the electrical contact 22 (i.e., removed from between the spring beam 52 and the outer wall 104) without damaging the electrical contact 22 such that another electrical wire 16 can be installed to the electrical contact 22; and/or (2) the corresponding electrical wire 16 can be installed in the same or another location.

Optionally, the spring beam 52 is compliant and flexible to enable the electrical contact 22 to accommodate a larger range of sizes of electrical wires. For example, the electrical contact 22 may be capable of accommodating at least four different sizes of electrical wires, such as, but not limited to, between 18-24 AWG.

Terminating an electrical wire with the compliant pinch connection of the electrical contacts 22 may require less force to achieve as compared to at least some other known connection types, for example as compared to terminating an electrical wire using an insulation displacement design (IDC) contact. In other words, it may require less force to pivot the spring beam 52 and pivot lever 28 open when the electrical wire 16 is poked-in to the housing 26 and thereby terminate electrical wires 16 as compared to the pivot blocks of at least some known pivot block style connectors, for example as compared to pivot block style connectors that use IDC contacts.

The embodiments described and/or illustrated herein may provide a poke-in style connector that can accommodate (i.e., terminate with a reliable electrical connection) a larger range of different sizes of electrical wires as compared to at least some known pivot block style connectors. The embodiments described and/or illustrated herein may provide a poke-in style connector that may require less force to terminate electrical wires as compared to at least some known pivot style connectors. The embodiments described and/or illustrated herein may provide a poke-in style connector that includes a single piece contact to make an electrical connection between an electrical wire and a mating contact, such as a mating contact of a thermostat.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. § 112(f), unless and until such claim limitations expressly use the phrase "means for" followed by a statement of function void of further structure.

What is claimed is:

1. A wall mountable connector mountable to a wall, wherein when the wall mountable connector is mounted to the wall, the wall mountable connector is configured to removably secure a thermostat to the wall, the wall mountable connector having a front housing and a back housing, wherein the back housing is configured to be mountable toward a wall, the wall mountable connector comprising:

a first connection block;

a second connection block spaced from the first connection block;

a field wire receiving cavity situated between the first connection block and the second connection block;

a field wire aperture extending through at least the back housing and into the field wire receiving cavity;

the first connection block including a front that faces forward and an inner side wall that defines at least part of the field wire receiving cavity and faces toward the second connection block;

the second connection block including a front that faces forward and an inner side wall that defines at least part of the field wire receiving cavity and faces toward the first connection block;

the first connection block further including:

a first column of pin terminals accessible from the front of the first connection block and configured to accommodate a first column of pins extending backward from a thermostat;

a first column of wiring terminals each accessible through a corresponding hole through the inner side wall of the first connection block and each configured to electrically connect to a field wire, each of the first column of wiring terminals electrical coupled with a corresponding one of the first column of pin terminals;

the second connection block further including:

a second column of pin terminals accessible from the front of the second connection block and configured to accommodate a second column of pins extending backward from the thermostat;

a second column of wiring terminals each accessible through a corresponding hole through the inner side wall of the second connection block and each configured to electrically connect to a field wire, each of the second column of wiring terminals electrical coupled with a corresponding one of the second column of pin terminals;

wherein a front side of the field wire receiving cavity is open to allow a user to gain access to electrically connect one or more field wires in the field wire receiving cavity to one or more of the wiring terminals of the first column of wiring terminals and/or to one or more of the wiring terminals of the second column of wiring terminals; and a door tethered to the wall mountable connector and movable between a closed position and an open position, the door remaining tethered to the wall mountable connector in both the closed position and the open position, wherein:

in the closed position, the door blocks user access from the front of the wall mountable connector to the field wire receiving cavity; and in the open position, the door allows user access from the front of the wall mountable connector to the field wire receiving cavity.

2. The wall mountable connector of claim 1, wherein:

the first connection block comprises a first column of first movable levers, wherein each first movable lever is movable between a closed resting position and an open release position, and wherein each of the first movable levers is configured to be moved by a user from the closed resting position to the open release position to release a field wire captured by a corresponding one of the wiring terminals of the first column of wiring terminals; and the second connection block comprises a second column of second movable levers, wherein each second movable lever is movable between a closed resting position and an open release position, and wherein each of the second movable levers is configured to be moved by the user from the closed resting position to the open release position to release a field wire captured by a corresponding one of the wiring terminals of the second column of wiring terminals.

3. The wall mountable connector of claim 2, wherein:

the first connection block comprises an outer side that faces away from the field wire receiving cavity, wherein the first column of first movable levers is positioned along the outer side of the first connection block; and the second connection block comprises an outer side that faces away from the field wire receiving cavity, wherein the second column of second movable levers is positioned along the outer side of the second connection block.

4. The wall mountable connector of claim 1, wherein:

the inner side wall of the first connection block extends from a back position more toward the back of the wall mountable connector to a front position more toward the front of the wall mountable connector;

the inner side wall of the second connection block extends from a back position more toward the back of the wall mountable connector to a front position more toward the front of the wall mountable connector; and wherein the back position of the inner side wall of the first connection block is closer to the back position of the inner side wall of the second connection block than the front position of the inner side wall of the first connection block is to the front position of the inner side wall of the second connection block.

5. The wall mountable connector of claim 1, further comprising two or more mounting holes extending through the wall mountable connector to facilitate mounting of the wall mountable connector to the wall.

6. The wall mountable connector of claim 5, wherein at least one of the two or more mounting holes is spaced from the field wire aperture and is positioned closer to a top of the wall mountable connector than the field wire aperture.

7. The wall mountable connector of claim 6, wherein at least one of the two or more mounting holes is spaced from the field wire aperture and is positioned closer a bottom of the wall mountable connector than the field wire aperture.

8. The wall mountable connector of claim 1, wherein the field wire receiving cavity has a back wall, wherein the field wire aperture extending through the back wall of the field wire receiving cavity.

9. The wall mountable connector of claim 1, wherein the wall mountable connector has a perimeter and a depth such that at least a majority of the wall mountable connector is received by a receiving cavity of the thermostat when the first column of pin terminals receive the first column of pins extending backward from the thermostat and the second column of pin terminals receive the second column of pins extending backward from the thermostat.

10. The wall mountable connector of claim 1, wherein:

the front housing defines a first forward facing surface situated between the first column of wiring terminals and the first column of pin terminals, the first forward facing surface including indicia identifying each of two or more of the wiring terminals of the first column of wiring terminals; and the front housing defines a second forward facing surface situated between the second column of wiring terminals and the second column of pin terminals, the second forward facing surface providing indicia identifying each of two or more wiring terminals of the second column of wiring terminals.

11. A wall mountable connector mountable to a wall, wherein when the wall mountable connector is mounted to the wall, the wall mountable connector is configured to removably secure a thermostat to the wall, the wall mountable connector having a front and a back, wherein the back is configured to be mountable toward a wall, the wall mountable connector comprising:

a first column of pin terminals accessible from a front of the wall mountable connector, the first column of pin terminals configured to receive a first column of pins extending backward from the thermostat;

a first column of wiring terminals accessible from a field wire receiving cavity of the wall mountable connector, each of the first column of wiring terminals configured to electrically connect to a field wire and each of the first column of wiring terminals electrical coupled with a corresponding one of the first column of pin terminals;

a second column of pin terminals accessible from the front of the wall mountable connector, the second column of pin terminals configured to receive a second column of pins extending backward from the thermostat;

a second column of wiring terminals accessible from the field wire receiving cavity of the wall mountable connector, each of the second column of wiring terminals configured to electrically connect to a field wire and each of the second column of wiring terminals electrical coupled with a corresponding one of the second column of pin terminals;

a front of the field wire receiving cavity open to allow a user to gain access and electrically connect field wires in the field wiring receiving cavity to the wiring terminals of the first column of wiring terminals and the wiring terminals of the second column of wiring terminals; and a door that is user manipulatable, when the thermostat is not mounted to the wall mountable connector, between a closed position in which the door blocks user access to the field wire receiving cavity and an open position in which the door does not block user access to the field wire receiving cavity, the door being free from any electrical pins extending through the door in both the open position and the closed position.

12. The wall mountable connector of claim 11, further comprising:

a column of first movable levers, wherein each first movable lever is movable between a closed resting position and an open release position, and wherein each of the first movable levers is configured to be moved by a user from the closed resting position to the open release position to release a field wire captured by a corresponding one of the wiring terminals of the first column of wiring terminals; and a column of second movable levers, wherein each second movable lever is movable between a closed resting position and an open release position, and wherein each of the second movable levers is configured to be moved by the user from the closed resting position to the open release position to release a field wire captured by a corresponding one of the wiring terminals of the second column of wiring terminals.

13. The wall mountable connector of claim 12, wherein the column of first movable levers and the column of second movable levers are accessible even when the door is in the closed position.

* * * * *